US006256915B1

(12) United States Patent
da Silveira

(10) Patent No.: US 6,256,915 B1
(45) Date of Patent: Jul. 10, 2001

(54) IN-CHAMBER CARTRIDGE INDICATOR FOR PISTOLS

(75) Inventor: Nilton da Silveira, Porto Alegre (BR)

(73) Assignee: Forjas Taurus S/A, Porto Alegre (BR)

( * ) Notice: Subject to any disclaimer, the term of this patent is extended or adjusted under 35 U.S.C. 154(b) by 0 days.

(21) Appl. No.: 09/473,388

(22) Filed: Dec. 28, 1999

(30) Foreign Application Priority Data

Dec. 29, 1998 (BR) ..... 9806734

(51) Int. Cl.[7] ..... F41A 9/53; F41A 15/10
(52) U.S. Cl. ..... 42/1.05; 42/1.05
(58) Field of Search ..... 42/1.05

(56) References Cited

U.S. PATENT DOCUMENTS 2,850,827 * 9/1958 Luciani ..... 42/1.05
3,561,396 * 2/1971 Luciani ..... 42/1.05
5,410,831 * 5/1995 Felk ..... 42/1.05
5,926,987 * 7/1999 Novak ..... 42/1.05

FOREIGN PATENT DOCUMENTS

271863 * 3/1914 (DE) ..... 42/1.05

* cited by examiner

*Primary Examiner*—Charles T. Jordan
*Assistant Examiner*—Lulit Semunegus
(74) *Attorney, Agent, or Firm*—Bachman & LaPointe, P.C.

(57) ABSTRACT

In-chamber cartridge indicator for pistols comprises an indicator (1) lodged in a respective groove (3) of extractor (1) and pivoted by pin (4) so that, when the respective ribs (12, 11) touch the cartridge breech (16) within the chamber, the synchronized movement thereof is prevented and the indicator (7) projects beyond the bolt (2), thereby to provide a visual and tactile indication of the weapon's loaded condition.

4 Claims, 3 Drawing Sheets

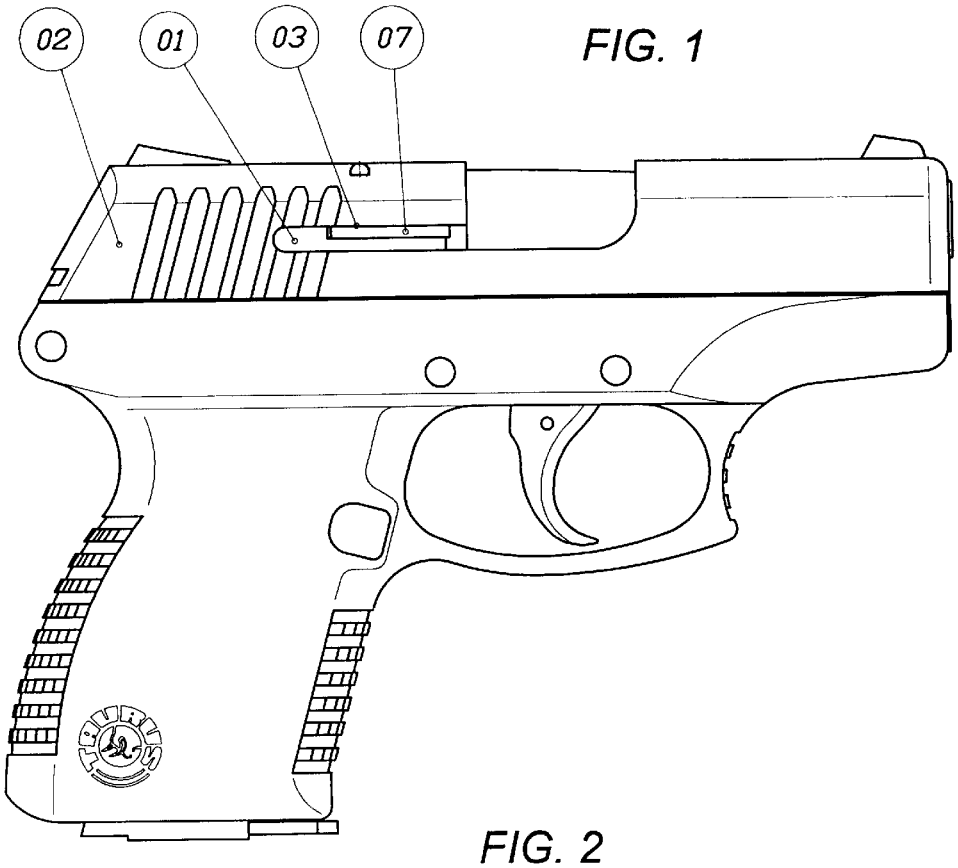
FIG. 1
FIG. 2
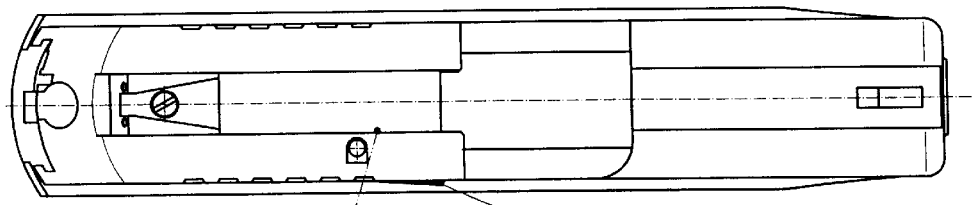
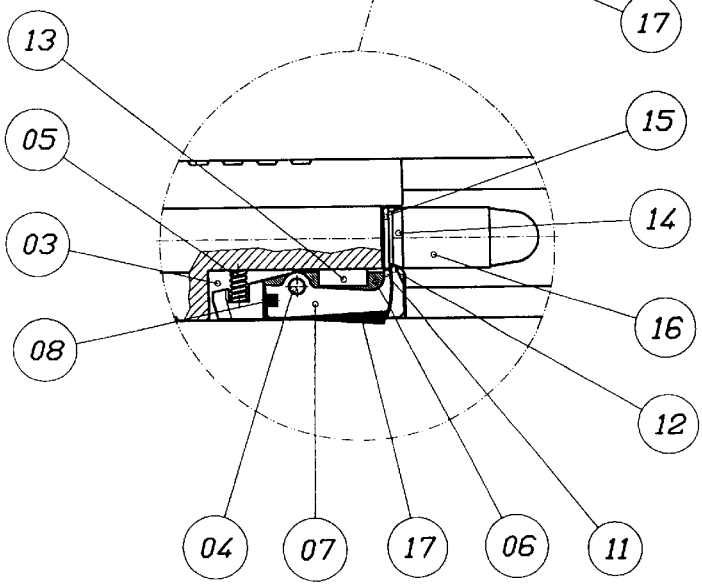
FIG. 3

IN-CHAMBER CARTRIDGE INDICATOR FOR PISTOLS

BACKGROUND OF THE INVENTION

The scope of this invention relates to a device for signalling and indicating the presence of cartridges within a pistol chamber.

The pistol-type semi-automatic weapons are characterized in that they possess a chamber incorporated to the weapon's barrel, to house a cartridge at the time of each firing. By reason of their particular configuration, the weapon's user or a bystander is not able to visually perceive whether the chamber is loaded or not, very pistol in this condition is in a potentially dangerous condition, since upon actuation of the trigger it will fire a shot that can be fatal.

Accordingly, it is entirely convenient that the weapon be provided with a device of any kind that can provide a visual and also—under low visibility conditions—tactile indication on the actual condition of the chamber, that is, whether it is loaded with a cartridge or not.

Several devices for indication of in-chamber cartridges are known in the state of the art. Some are of the type wherein a pin protudes from the rear area of the bolt whenever a cartridge is present in the chamber. Such arrangement is expensive and complicated, since it is necessary to provide a long space through the weapon's breech for a pin with an incorporated return spring be properly housed therein, making contact with the cartridge's rear face, whenever it is lodged in the chamber.

More recently, the BERETTA and TAURUS pistons have incorporated in-chamber cartridge indicators by taking advantage of the extractor, which is housed in one of the sides of the bolt. This kind of concept, albeit very simple, is of difficult practical application, as it depends on the force applied by the cartridge's side against the extractor spring, causing the latter to have a slight lateral movement, protuding from the bolt's lateral surface. The construction difficulties basically reside in that it is absolutely necessary to have an interference between the extractor and the cartridge's side in order to provide the extractor's projection so that it becomes visible and detectable. At the same time, additional operating difficulties are introduced in the weapon, mainly at the time of feeding a cartridge, which requires another amount of energy and adjustments for the latter to lodge itself properly in the chamber.

SUMMARY OF THE INVENTION

The scope of the present invention is an in-chamber cartridge indicator for pistols that allows a visual and tactile indication, by means of utilization of a lever incorporated to the extractor, the actuation of which does not interfere with the weapon's loading cycle; accordingly, it does not involve additional difficulties and adjustments.

BRIEF DESCRIPTION OF THE DRAWINGS

The indicating device subject matter of the present invention will be best understood in the light of the following description, made in relation with the appended figures, that illustrate a preferred—not limiting—manner of production of the present invention, wherein:

FIG. 1 is a side view of a pistol;

FIG. 2 is an upper view of the pistol in the loaded condition, with a cartridge in the chamber;

FIG. 3 is a section view of the bolt, showing the extractor and the cartridge indicator protuding laterally from the bolt;

DETAILED DESCRIPTION

Figure 4:
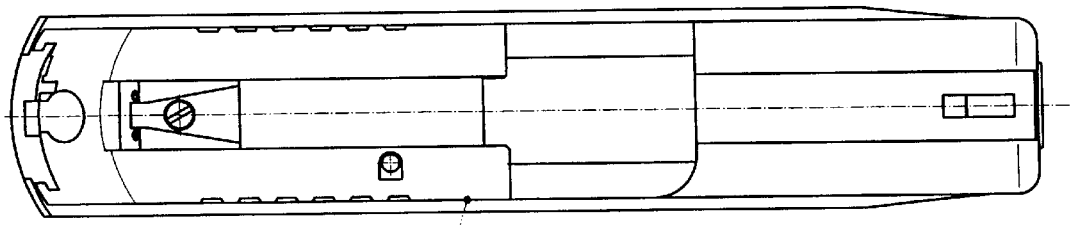
FIG. 4 is an upper view of the pistol in the unloaded condition.

In accordance with the appended drawings, the in-chamber cartridge indicator for pistols subject matter of the present invention comprises an extractor (1) lodged in the bolt (2), within an appropriate groove (3). The extractor (1) is pivoted by pin (4) lodged in the bolt (2) and is maintained in a proper position by the pressure applied by spring (5).

Associated to the extractor (1) and assembled in a recess (6) therein, is the indicator (7), which is also pivoted by pin (4) and driven by the indicator spring (8), which is considerably weaker than spring (6), which is lodged in the proper groove (9) in the indicator (7).

The spring in this condition, supported on wall (10) of recess (6) of extractor (1), forces the indicator (7), causing the rib (11) thereof to align itself with the extractor's rib (12). This alignment takes place by reason that a larger rotation of indicator (7) is prevented by the abutment (13) of extractor (1).

Figure 5:
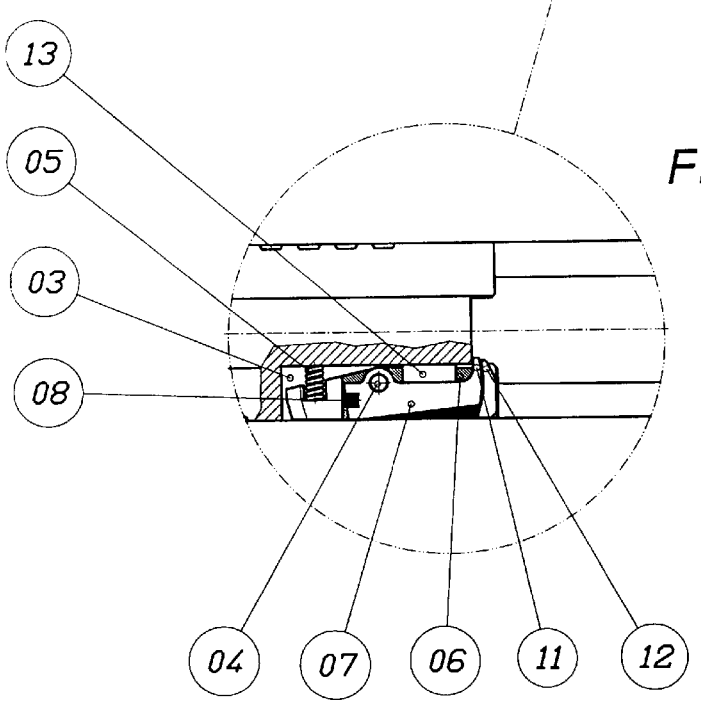
FIG. 5 is a section view of the bolt, showing the extractor and the cartridge indicator in the recessed condition.
Figure 6:
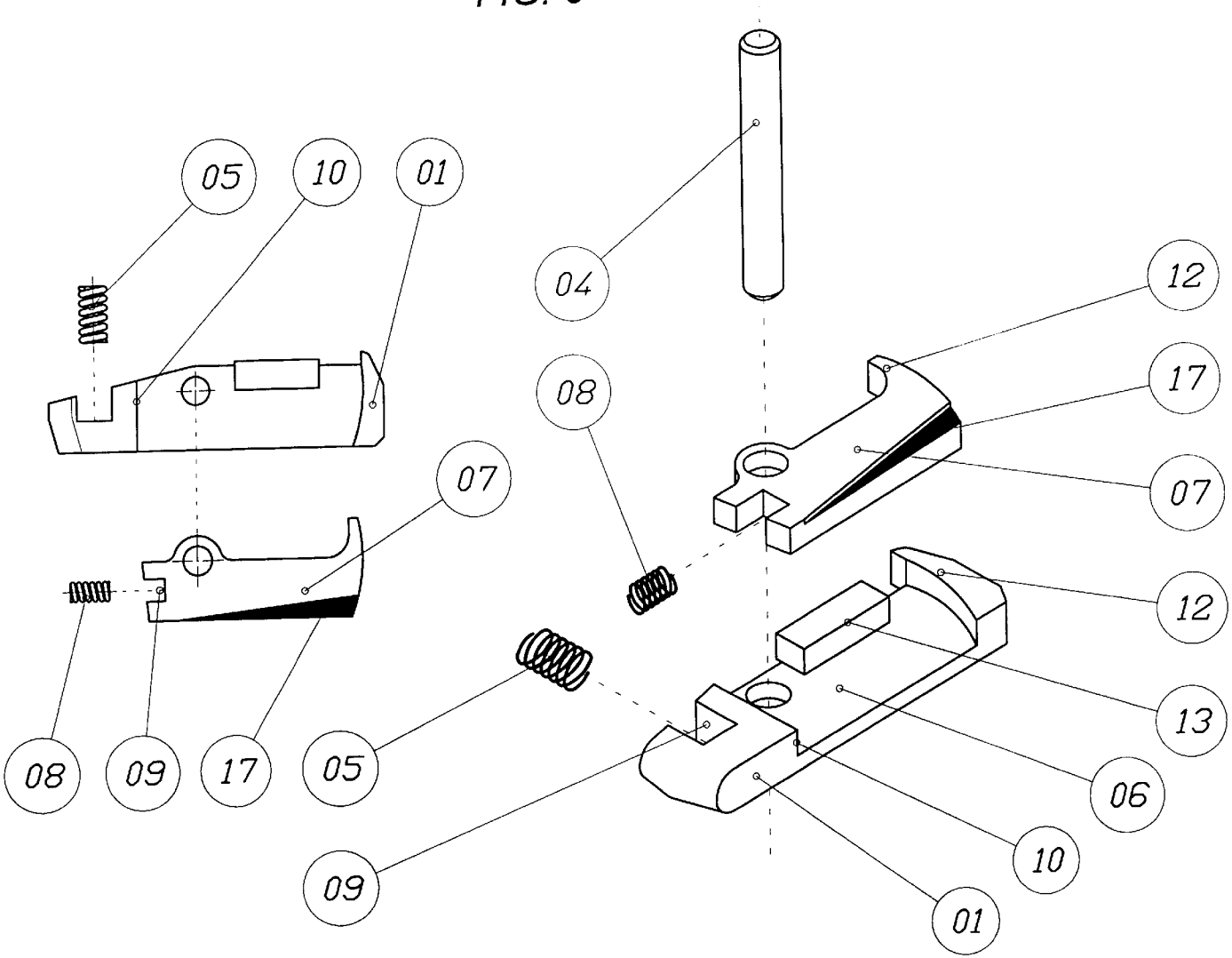
FIG. 6 is an exploded view of the extractor and indicator with their springs and attachment pin.

The above condition is characteristic of an unloaded weapon, or without a cartridge in the chamber, wherein it is not possible to perceive by sight or tact the indicator's protrusion, as specifically illustrated on FIGS. 4 and 5.

When the weapon is loaded, with a cartridge in the chamber, as shown on FIGS. 2 and 3, the rib (12) of extractor (1) is fitted within the recess (14) of breech (15) of cartridge (16). This positioning is fundamental for extracting the cartridge (15) after firing.

In its turn, the indicator (7) which, on being solidary with the extractor (1), tends to follow the former, as shown on FIGS. 4 and 5, will not do so in this case, since the movement of its rib (11) is prevented by the edge of breech (15) of cartridge (16).

In this case, a portion (17) of the outer side of indicator (7) objects from the outer surface of bolt (2). Such protrusion is easily perceivable by eye or finger contact, being therefore an indication of a potentially dangerous condition, since the weapon is loaded. After an eventual and deliberate firing, and in the event that there are no more cartridges in the loader for feeding thereof, the extractor-indicator system returns to its initial condition, and the indicator's protrusion disappears.

For an easier observation, the outer portion (17) of indicator (7) is preferably painted red.

What is claimed is:

1. A pistol comprising a bolt (2); an extractor provided in the bolt (2), the extractor (1) having a recess (6), a rib (12) and a pivot pin (4); and a pistol chamber for receiving a cartridge (16) having a breech (15) with a recess (14); the improvement which comprises: an in-chamber cartridge indicator for providing a visual and tactile indication of the presence of the cartridge in the pistol chamber, said indicator comprising a clamp-shaped indicator (7) frontally provided with a rib (11) and rearwardly with a groove (9) for housing a spring (8), said indicator (7) being pivoted on the pin (4) and arranged in the respective recess (6) of the extractor (1), so that the rib (11) of indicator (7) is parallel to rib (12) of extractor, so that both ribs (11, 12) contact the recess (14) of breech (15) of cartridge (16), respectively, when the cartridge is lodged in the pistol chamber.

2. A pistol in accordance with claim 1, wherein the extractor (1) and indicator (7) are pivoted by pin (4).

3. A pistol in accordance with claim 1, wherein an outer portion (17) of indicator (7) is colored.

4. A pistol in accordance with claim 3, wherein the color is red.

* * * * *